US009844105B2

(12) United States Patent
Ido

(10) Patent No.: US 9,844,105 B2
(45) Date of Patent: Dec. 12, 2017

(54) LIGHTING DEVICE HAVING A SHUNT CIRCUIT IN PARALLEL WITH A LIGHT SOURCE CIRCUIT THEREIN

(71) Applicant: Panasonic Intellectual Property Management Co., Ltd., Osaka (JP)

(72) Inventor: Shigeru Ido, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 15/430,669

(22) Filed: Feb. 13, 2017

(65) Prior Publication Data

US 2017/0238378 A1 Aug. 17, 2017

(30) Foreign Application Priority Data

Feb. 16, 2016 (JP) ..... 2016-027165

(51) Int. Cl.
*H05B 37/02* (2006.01)
*H05B 33/08* (2006.01)

(52) U.S. Cl.
CPC ..... *H05B 33/0809* (2013.01); *H05B 33/089* (2013.01); *H05B 33/083* (2013.01); *H05B 33/0827* (2013.01); *H05B 33/0845* (2013.01)

(58) Field of Classification Search
CPC ..... H05B 33/083; H05B 33/0827; H05B 33/0845
USPC ..... 315/185 R, 291, 306, 360
See application file for complete search history.

(56) References Cited

U.S. PATENT DOCUMENTS 8,531,115 B2 * 9/2013 Blanchard ..... H05B 33/0824 315/122
9,107,263 B2 * 8/2015 Blanchard ..... H05B 33/0824
9,485,830 B2 * 11/2016 Sakai ..... H05B 33/0824
9,510,407 B2 * 11/2016 Akiyama ..... H05B 33/0815

FOREIGN PATENT DOCUMENTS

JP 2013-055168 A 6/2006

* cited by examiner

*Primary Examiner* — Thuy Vinh Tran
(74) *Attorney, Agent, or Firm* — Renner, Otto, Boisselle & Sklar, LLP

(57) ABSTRACT

A lighting device includes a rectifier circuit, a driver circuit and a shunt circuit. The driver circuit is configured to apply respective voltage components contained in a pulsating voltage from the rectifier circuit every period of the pulsating voltage across part and all of solid light sources in response to the pulsating voltage and respective ON voltages of light source circuits including the part and all of the solid light sources. The shunt circuit is electrically connected in parallel with a light source circuit having a lowest ON voltage of the light source circuits, and configured to set a value of an output current from the rectifier circuit to a value proportional to a value of the pulsating voltage while the pulsating voltage is less than the lowest ON voltage.

11 Claims, 10 Drawing Sheets

LIGHTING DEVICE HAVING A SHUNT CIRCUIT IN PARALLEL WITH A LIGHT SOURCE CIRCUIT THEREIN

CROSS REFERENCE TO RELATED APPLICATION

This application claims the benefit and priority of Japanese Patent Application No. 2016-027165, filed on Feb. 16, 2016, the entire contents of which is incorporated herein by reference.

TECHNICAL FIELD

The disclosure relates generally to lighting devices and lighting equipment and, more particularly, to a lighting device configured to apply respective voltage components contained in a pulsating voltage from an AC power supply every period of the pulsating voltage across part and all of solid light sources, and lighting equipment with the lighting device.

BACKGROUND ART

As a related device, there has been provided a lighting device that is configured to supply solid light sources with a pulsating voltage derived from an AC (alternating-current) voltage supplied from an AC power supply, thereby lighting the solid light sources (see, e.g., an LED driver circuit described in JP 2013-55168A (hereinafter referred to as "Document 1")). The lighting device (LED driver circuit) described in Document 1 includes a full-wave rectifier circuit composed of diodes, a first bypass circuit, a first LED array, a second bypass circuit, a second LED array and a constant current circuit. Each of the first and second LED arrays is formed of a series circuit of LEDs.

Two input terminals of the first bypass circuit are electrically connected one-to-one with two pulsating output terminals of the full-wave rectifier circuit. A positive end (anode) of the first LED array is electrically connected to a high potential side output terminal of the first bypass circuit. A negative end (cathode) of the first LED array is electrically connected to a high potential side input terminal of the second bypass circuit. A low potential side output terminal of the first bypass circuit is electrically connected to a low potential side input terminal of the second bypass circuit. A positive end (anode) of the second LED array is electrically connected to a high potential side input terminal of the second bypass circuit. A negative end (cathode) of the second LED array is electrically connected to an input terminal of the constant current circuit. A low potential side output terminal of the second bypass circuit is electrically connected to an output terminal of the constant current circuit. Each of the first and second bypass circuits is composed of transistors, resistors and the like.

The lighting device described in Document 1 is configured so that the first bypass circuit allows a first bypass current to flow through during a period of time while no current flows through the first LED array, thereby reducing harmonic distortion of comparatively lower harmonics that may occur in an input current.

Incidentally, in the first bypass circuit in the related device described in Document 1, the two input terminals are electrically connected one-to-one with the two pulsating output terminals of the full-wave rectifier circuit. The first bypass circuit accordingly needs, as a component thereof, a transistor having a blocking voltage higher than a peak voltage of the pulsating voltage, which causes a rise in production cost.

SUMMARY OF THE INVENTION

It is an object of the disclosure to provide a lighting device and lighting equipment, capable of reducing harmonic distortion of an input current and suppressing a rise in production cost.

A lighting device according to one aspect of the disclosure includes a rectifier circuit, a driver circuit and a shunt circuit. The rectifier circuit includes a first polarity output terminal and a second polarity output terminal, and is configured to output a pulsating voltage obtained by rectifying an AC voltage from the first polarity and second polarity output terminals. The driver circuit is configured to apply respective voltage components contained in the pulsating voltage every period of the pulsating voltage across part and all of solid light sources in response to the pulsating voltage and respective ON voltages of light source circuits including the part and all of the solid light sources. The shunt circuit is electrically connected in parallel with a light source circuit having a lowest ON voltage of the light source circuits. The shunt circuit is configured to set a value of an output current from the rectifier circuit to a value proportional to a value of the pulsating voltage while the pulsating voltage is less than the lowest ON voltage.

Lighting equipment according to one aspect of the disclosure includes the lighting device, and a body that holds the lighting device.

BRIEF DESCRIPTION OF THE DRAWINGS

The figures depict one or more implementations in accordance with the present teaching, by way of example only, not by way of limitation. In the figures, like reference numerals refer to the same or similar elements where:

FIGS. 3A to 3D show current paths in the lighting device in which FIG. 3A is a circuit diagram showing a current path in a first mode, FIG. 3B is a circuit diagram showing a current path in a second mode, FIG. 3C is a circuit diagram showing a current path in a third mode, and FIG. 3D is a circuit diagram showing a current path in a fourth mode;

FIGS. 10A, 10B and 10C show lighting equipment in accordance with Embodiment 3 in which FIG. 10A is a perspective view of the lighting equipment, FIG. 10B is a perspective view of Modified example 1 of the lighting equipment, and FIG. 10C is a perspective view of Modified example 2 of the lighting equipment.

DETAILED DESCRIPTION

Figure 1:
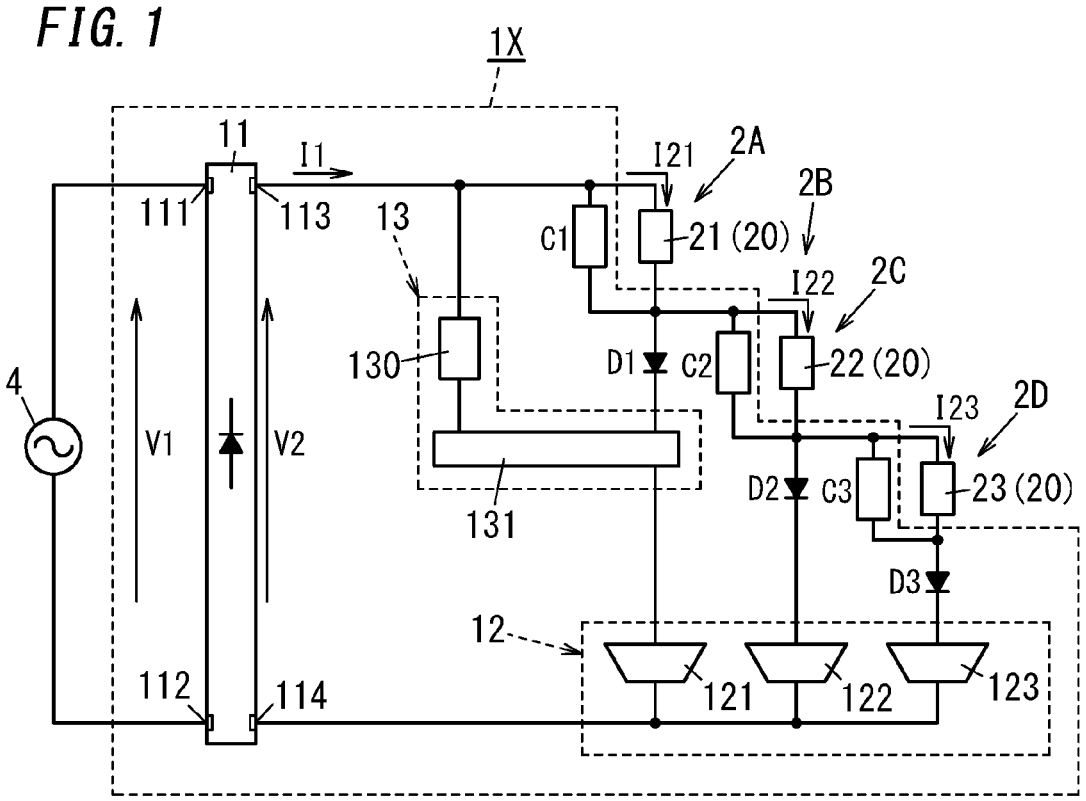
FIG. 1 is a block diagram of a lighting device in accordance with Embodiment 1.

Hereinafter, lighting devices and respective lighting equipment in embodiments will be explained.

Embodiment 1

The present embodiment is explained with reference to FIG. 1. Note that in the example of FIG. 1, a lighting device 1X includes three solid light sources 20, but a lighting device of the present embodiment is not limited to this. For example, the lighting device of the embodiment may include two solid light sources 20, or four or more solid light sources 20. In short, the lighting device of the embodiment includes solid light sources 20. Each of the solid light sources 20 may be a solid light source array composed of LEDs (light emitting diodes). Each of the solid light sources 20 may be also electrically connected in parallel with a capacitor.

The lighting device of the embodiment includes a rectifier circuit 11, a driver circuit 12 and a shunt circuit 13. The rectifier circuit 11 includes a first polarity output terminal 113 and a second polarity output terminal 114 and that is configured to output, from the first polarity and second polarity output terminals 113 and 114, a pulsating voltage V2 obtained by rectifying an AC voltage V1. Desirably, the rectifier circuit 11 is a full-wave rectifier circuit. The driver circuit 12 is configured to apply respective voltage components contained in the pulsating voltage V2 every period of the pulsating voltage V2 across part and all of the solid light sources 20 in response to the pulsating voltage V2 and respective ON voltages of light source circuits including the part and all of the solid light sources 20. In an example, the driver circuit 12 is electrically connected in series with the solid light sources 20 between the first polarity and second polarity output terminals 113 and 114, and functions as a constant current source that allows respective currents from the light source circuits to flow through as a constant current. In another example, each of the light source circuits may further include a diode connected in series to its own one or more solid light sources 20. The shunt circuit 13 is electrically connected in parallel with a light source circuit having a lowest ON voltage of the light source circuits. For example, the shunt circuit 13 may be configured to set a value of an output current I1 from the rectifier circuit 11 to a value proportional to a value of the pulsating voltage V2 while the pulsating voltage V2 is less than the lowest ON voltage V21. In the example of FIG. 1, the first polarity is positive polarity, and the second polarity is negative polarity.

In a first specific example of the embodiment, the solid light sources 20 includes at least two adjoining solid light sources between the first polarity and second polarity output terminals 113 and 114. The adjoining solid light sources are connected in series. The adjoining solid light sources include first polarity side solid light source 21 or 22 and second polarity side solid light source 22 or 23. Note that an element other than such a solid light source (e.g., a diode) may intervene between the two adjoining first polarity side solid light source and second polarity side solid light source. A first light source circuit of the light source circuits has a first voltage as an ON voltage. The first light source circuit includes every solid light source, a circuit route of which is nearer to the first polarity output terminal 113 than a circuit route of the second polarity side solid light source, of the solid light sources 20. A second light source circuit of the light source circuits has a second voltage as an ON voltage. The second light source circuit includes every solid light source, on a side of the first polarity output terminal 113 from the second polarity side solid light source, of the solid light sources 20.

The first specific example can be applied to a configuration as a modified example of FIG. 1, in which a lighting device includes two solid light sources 21 and 22 but does not include a solid light source 23 (hereinafter referred to as a "two-light source configuration"). In the two-light source configuration, a first light source circuit (hereinafter referred to as a "first light source circuit 2A") includes every solid light source 21, a circuit route of which is nearer to the first polarity output terminal 113 than a circuit route of the second polarity side solid light source 22, of the solid light sources 21 and 22. In an example, the first light source circuit 2A includes the first polarity side solid light source 21, and a diode D1 connected in series thereto, and has an ON voltage V21 shown in the example of FIG. 2 as a first voltage (hereinafter referred to as a "first voltage V21"). However, the ON voltage of the diode D1 is not shown in the example of FIG. 2. On the other hand, a second light source circuit (hereinafter referred to as a "second light source circuit 2B") includes every solid light source 21-22, on the side of the first polarity output terminal 113 from the second polarity side solid light source 22, of the solid light sources 21 and 22. In an example, the second light source circuit 2B includes the solid light sources 21 and 22, and a diode D2 connected in series thereto, and has an ON voltage V21+V22 shown in the example of FIG. 2 as a second voltage (hereinafter referred to as a "second voltage V21−V22"). However, the ON voltage of the diode D2 is not shown in the example of FIG. 2.

The first specific example can be also applied to the configuration of FIG. 1 in which the lighting device includes three solid light sources 21 to 23 (hereinafter referred to as a "three-light source configuration"). In the three-light source configuration, the lighting device includes a first light source circuit 2A and a second light source circuit 2B, like the two-light source configuration. In addition, the lighting device includes another first light source circuit (hereinafter referred to as a "first light source circuit 2C") and another second light source circuit (hereinafter referred to as a "second light source circuit 2D"). The first light source circuit 2C includes every solid light source 21-22, a circuit route of which is nearer to the first polarity output terminal 113 than a circuit route of the second polarity side solid light source 23, of the solid light sources 21 to 23. In short, such a circuit route means a route on an electrical circuit (e.g., the circuit as shown in FIG. 1). For example, in the circuit of FIG. 1 (three-light source configuration), the circuit route of the solid light sources 21-22 contained in the first light source circuit 2C is nearer to the first polarity output terminal 113 than a circuit route of the second polarity side solid light source 23, of solid light source 21-23. Therefore, even if the second polarity side solid light source 23 is physically nearer to the first polarity output terminal 113 than the solid light sources 21-22, the second polarity side solid light source 23 is not contained in the first light source circuit 2C. In an example, the first light source circuit 2C includes the solid light sources 21 and 22, and a diode D2 connected in series thereto, and has an ON voltage V21+V22 shown in the example of FIG. 2 as another first voltage (hereinafter referred to as a "first voltage V21-V22"). On the other hand, the second light source circuit 2D includes every solid light source 21-23, on the side of the first polarity output terminal 113 from the second polarity side solid light source 23, of the solid light sources 21 to 23. In an example, the second light source circuit 2D includes the solid light sources 21 to 23, and a diode D3 connected in series thereto, and has an ON voltage V21+V22+V23 shown in the example of FIG. 2 as another second voltage (hereinafter referred to as a "second voltage V21-V23"). However, the ON voltage of the diode D3 is not shown in the example of FIG. 2.

In a second specific example of the embodiment, the driver circuit 12 is configured to allow a current (only) from the first light source circuit to flow through during (only) a period of time while the pulsating voltage V2 is greater than or equal to the first voltage and less than the second voltage.

The second specific example can be applied to the two-light source configuration. In the two-light source configuration, the driver circuit 12 is configured to allow a current from (only) the first light source circuit 2A (21, D1) to flow through during (only) a period of time T2, T6 in which the pulsating voltage V2 is greater than or equal to the first voltage V21 and less than the second voltage V21-V22.

The second specific example can be applied to the three-light source configuration. In the three-light source configuration, the driver circuit 12 is configured to allow a current from (only) the first light source circuit 2A to flow through, like the two-light source configuration The driver circuit 12 is further configured to allow a current from (only) the first light source circuit 2C (21-22, D2) to flow through during (only) a period of time T3, T5 in which the pulsating voltage V2 is greater than or equal to the first voltage V21-V22 and less than the second voltage V21-V23.

As a third specific example of the embodiment, in a configuration in which the second polarity side solid light source is a solid light source, a circuit route of which is nearest to the second polarity output terminal 114, the driver circuit 12 is configured to allow a current from (only) the second light source circuit to flow through during (only) a period of time while the pulsating voltage V2 is greater than or equal to the second voltage. In a configuration in which the second polarity side solid light source is a solid light source other than the solid light source, a circuit route of which is nearest to the second polarity output terminal 114, the driver circuit 12 is configured to allow a current from (only) the second light source circuit to flow through during (only) a period of time while the pulsating voltage V2 is greater than or equal to the first voltage and less than the second voltage.

The third specific example can be applied to the two-light source configuration. In the two-light source configuration, the second polarity side solid light source 22 is a solid light source, a circuit route of which is nearest to the second polarity output terminal 114. In this configuration, the driver circuit 12 is configured to allow a current from (only) the second light source circuit 2B (21-22, D2) to flow through during (only) a period of time T3-T5 in which the pulsating voltage V2 is greater than or equal to the second voltage V21-V22.

The third specific example can be applied to the three-light source configuration. In the three-light source configuration, the lighting device includes the second light source circuit 2B (21-22, D2) and the second light source circuit 2D (21-23, D3). The second light source circuit 2B (21-22, D2) does not include the solid light source 23, a circuit route of which is nearest to the second polarity output terminal 114. The driver circuit 12 is therefore configured to allow a current from (only) the second light source circuit 2B to flow through during (only) a period of time T3, T5 in which the pulsating voltage V2 is greater than or equal to the first voltage V21-V22 and less than the second voltage V21-V23. The second light source circuit 2D (21-23, D3) includes the solid light source 23, a circuit route of which is nearest to the second polarity output terminal 114. The driver circuit 12 is therefore configured to allow a current from (only) the second light source circuit 2D to flow through during (only) a period of time T4 in which the pulsating voltage V2 is greater than or equal to the second voltage V21-V23.

The driver circuit 12 is configured to electrically connect the shunt circuit 13 between the first polarity and second polarity output terminals 113 and 114 while the pulsating voltage V2 is less than the lowest ON voltage V21. The lowest ON voltage V21 is an ON voltage of the light source circuit including the solid light source 21, a circuit route of which is nearest to the first polarity output terminal 113, of the solid light sources 20. In the example of FIG. 1, the lowest ON voltage V21 is the ON voltage of the light source circuit including only the solid light source 21 and the diode D1.

In the embodiment, the shunt circuit 13 includes a bleeder resistor 130.

Figure 4:
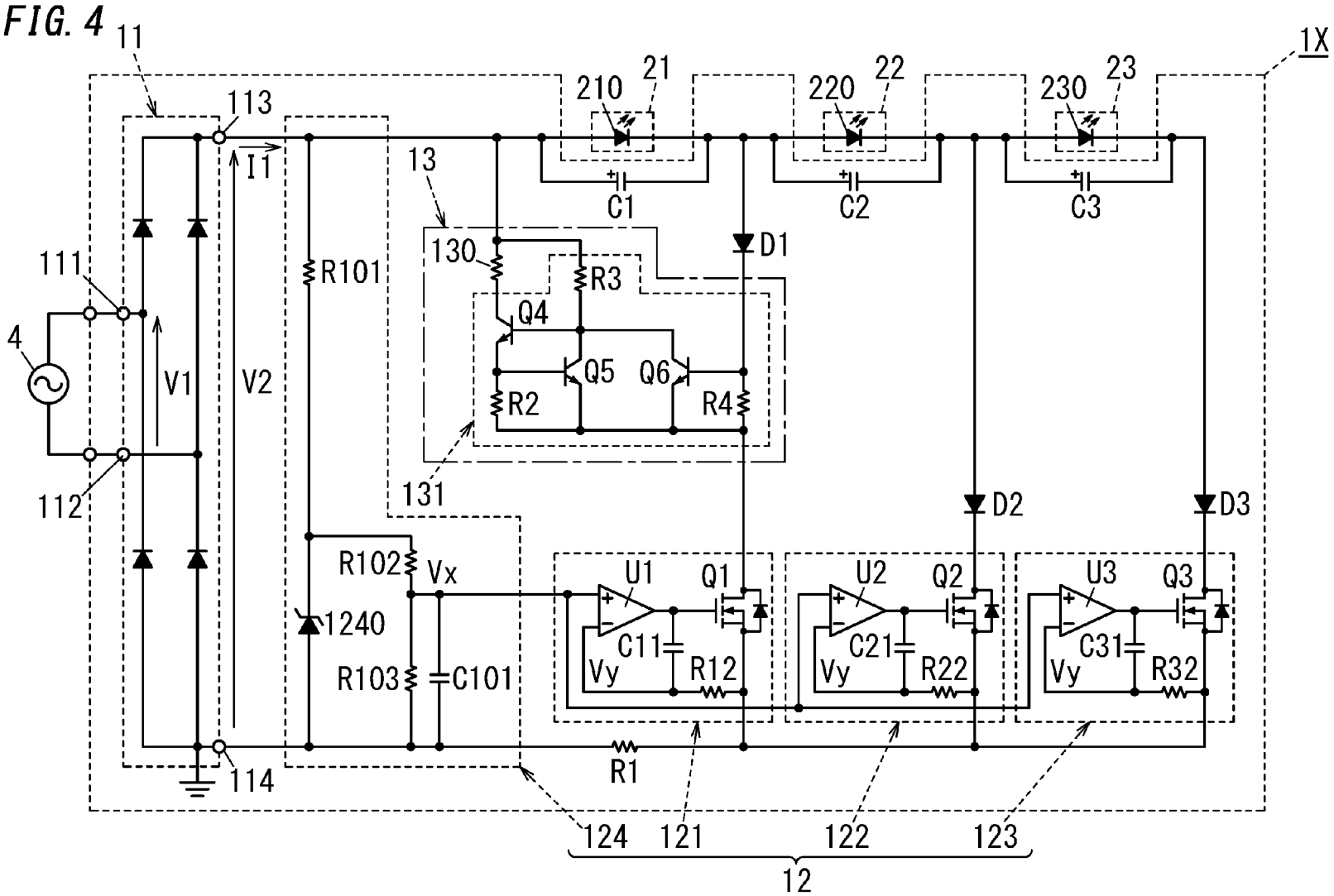
FIG. 4 is a circuit diagram of the lighting device.
Figure 5:
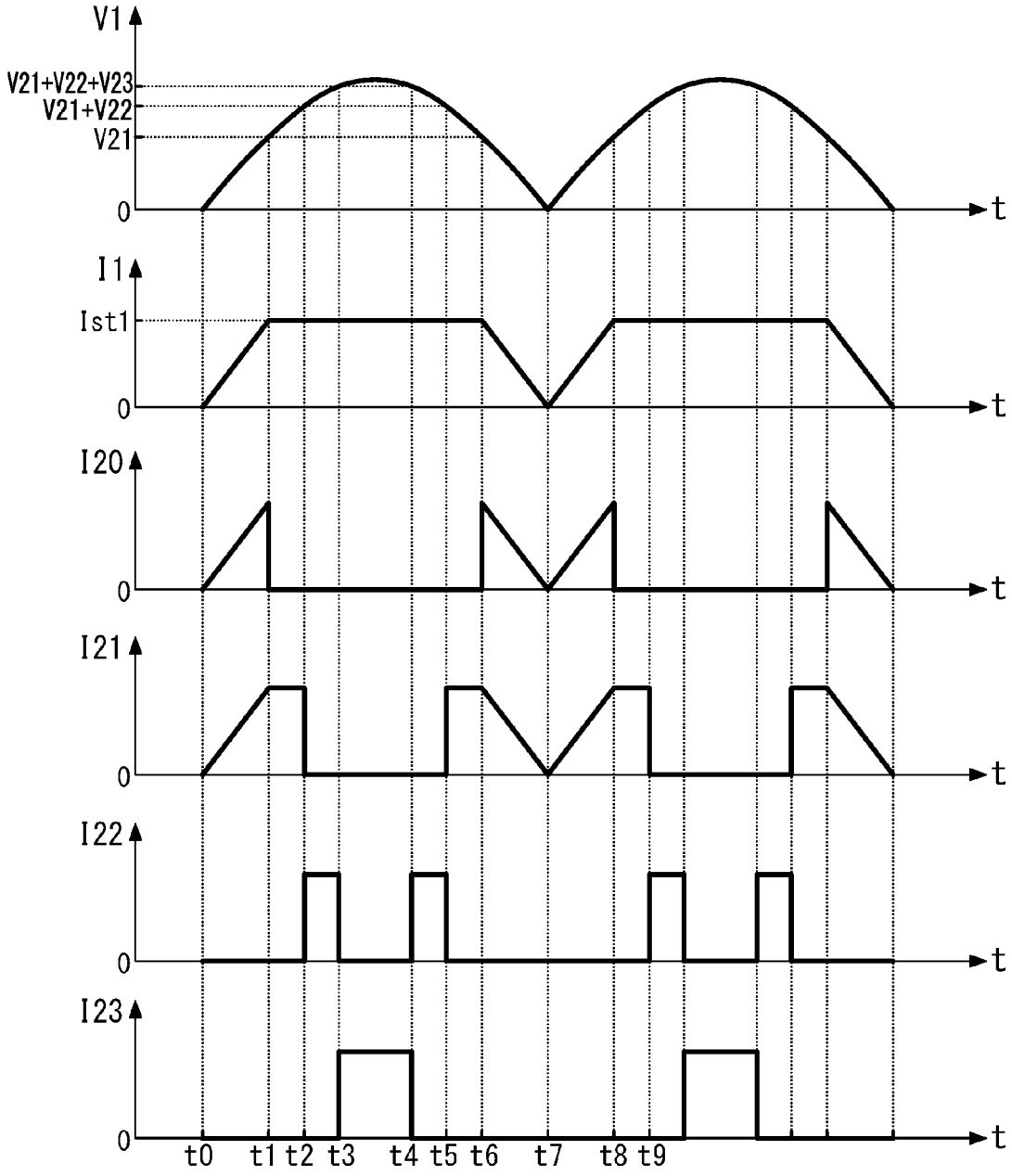
FIG. 5 shows waveforms illustrating operations of the lighting device.

As a fourth specific example of the embodiment, the lighting device includes a reference power supply (124 in the examples of FIGS. 4, 8 and 9) and a current sensor (R1 in the examples). The reference power supply is configured to generate a reference voltage Vx. The current sensor R1 intervenes between the driver circuit 12 and a side, a circuit route of which is nearer to one of the first polarity and second polarity output terminals 113 and 114 than a circuit route of the driver circuit 12 (a 114 side in the examples). In addition, the driver circuit 12 includes at least first and second circuits (121 or 122 and 122 or 123 in the examples). The first and second circuits are electrically connected in series to the aforementioned at least two adjoining first polarity side solid light source 21 or 22 and second polarity side solid light source 22 or 23, respectively between the first polarity and second polarity output terminals 113 and 114. Each of the first and second circuits is, for example a constant current circuit configured to cause a value of a current detected through the current sensor to accord with a current value corresponding to the reference voltage Vx. In an example, the reference power supply is configured to: generate a voltage proportional to the pulsating voltage V2 while a value of the pulsating voltage V2 is less than the reference voltage Vx; and generate the reference voltage Vx while the value of the pulsating voltage V2 is greater than or equal to the reference voltage Vx In the fourth specific example, the first circuit 121 electrically connected in series to only the first polarity side solid light source 21, a circuit route of which is nearest to the first polarity output terminal 113 includes an operational amplifier (U1 in the examples) and a transistor (Q1 in the examples). The operational amplifier U1 has a non-inverting input terminal which the reference voltage Vx is applied to, an inverting input terminal which a voltage derived from the current sensor R1 is applied to, and an output terminal. The transistor Q1 has a control terminal (a gate) electrically connected to the output terminal of the operational amplifier U1, a first end (a drain) electrically connected to the first polarity side solid light source 21, and a second end (a source) electrically connected to the current sensor R1. In this example, because the first polarity side solid light source 21 conducts while the pulsating voltage V2 is greater than or equal to the first voltage V21, a current is to flow from the first polarity side solid light source 21 to the first circuit 121 (transistor Q1). The first circuit 121 is set to be non-conductive while the pulsating voltage V2 is greater than or equal to the second voltage V21-V22. As shown in the example of FIG. 5, the first circuit 121 allows a current from only the first polarity side solid light source 21 to flow through during only a period of time while the pulsating voltage V2 is greater than or equal to the first voltage V21 and less than the second voltage V21-V22. The second circuit may be also configured like the first circuit.

In the fourth specific example, the shunt circuit 13 includes a series circuit, a resistor R4 and a switch device Q6. The series circuit is, for example a bleeder resistor 130 and a switch device Q4 that are electrically connected between the first polarity and second polarity output terminals 113 and 114. The resistor R4 is electrically connected in series to the solid light source 21, a circuit route of which is nearest to the first polarity output terminals 113, of the solid light sources 20. The switch device Q6 is configured to turn on in response to a voltage across the resistor R4, thereby turning off the switch device Q4 of the series circuit.

Hereinafter, the embodiment is explained with reference to the example of FIG. 1. As shown in FIG. 1, a lighting device 1X according to Embodiment 1 includes a rectifier circuit 11, a driver circuit 12 and a shunt circuit 13. The rectifier circuit 11 includes a first input terminal 111, a second input terminal 112, a first polarity output terminal 113 and a second polarity output terminal 114. The first input terminal 111 is configured to be electrically connected to one end (e.g., a live conductor) of an AC power supply 4. The second input terminal 112 is configured to be electrically connected to another end (e.g., a neutral conductor) of the AC power supply 4. The first polarity output terminal 113 is configured to be electrically connected with a positive electrode of a first solid light source 21. The second polarity output terminal 114 is electrically connected to an output end of the driver circuit 12. For example, the rectifier circuit 11 may be a diode bridge. The rectifier circuit 11 is configured to generate a pulsating voltage V2 by full-wave rectifying an AC voltage V1 from the first and second input terminals 111 and 112 to output the pulsating voltage V2 from the first polarity and second polarity output terminals 113 and 114. Note that each of the "input terminals" and "output terminals" may include a component (a screw terminal or the like) that allows an electric wire or the like to be electrically and mechanically connected to, but may be, for example a lead of an electronic component or part of conductive pattern of a printed circuit board.

Preferably, each of the first solid light source 21, a second solid light source 22 and a third solid light source 23 is composed of a series circuit of light emitting devices. The first solid light source 21 is also electrically connected in parallel with a first capacitor C1. The second solid light source 22 is electrically connected in parallel with a second capacitor C2. The third solid light source 23 is electrically connected in parallel with a third capacitor C3. A negative electrode of the first solid light source 21 is electrically connected to an anode of a first diode D1. A negative electrode of the second solid light source 22 is electrically connected to an anode of a second diode D2. A negative electrode of the third solid light source 23 is electrically connected to an anode of a third diode D3. The first, second and third solid light sources 21, 22 and 23 conduct and emit respective light (are lit) while respective voltages applied across their own positive and negative electrodes is greater than or equal to their respective ON voltages (first, second and third ON voltages V21, V22 and V23).

The driver circuit 12 has a first constant current circuit 121, a second constant current circuit 122 and a third constant current circuit 123. An input terminal of the first constant current circuit 121 is electrically connected to a cathode of the first diode D1 via the shunt circuit 13. An input terminal of the second constant current circuit 122 is electrically connected to a cathode of the second diode D2. An input terminal of the third constant current circuit 123 is electrically connected to a cathode of the third diode D3. Output terminals of the first, second and third constant current circuits 121, 122 and 123 are electrically connected to the second polarity output terminal 114 of the rectifier circuit 11. Each of the first, second and third constant current circuits 121, 122 and 123 is configured to convert a current entering its own input terminal into a constant current to output the constant current from its own output terminal. Note that the first, second and third constant current circuits 121, 122 and 123 are configured to operate alone and two or more of them do not operate at the same time.

The shunt circuit 13 has a bleeder resistor 130 and a control circuit 131. The shunt circuit 13 is electrically connected in parallel with a series circuit of the first solid light source 21 and the first diode D1. A first end of the bleeder resistor 130 is electrically connected to the first polarity output terminal 113 of the rectifier circuit 11 and the positive electrode of the first solid light source 21. The control circuit 131 is configured to allow a current (a bleeder current) to flow through the bleeder resistor 130 while the first solid light source 21 is non-conductive (it is unlit) and prohibit the bleeder current from flowing while the first solid light source 21 is conductive (it is lit).

Figure 2:
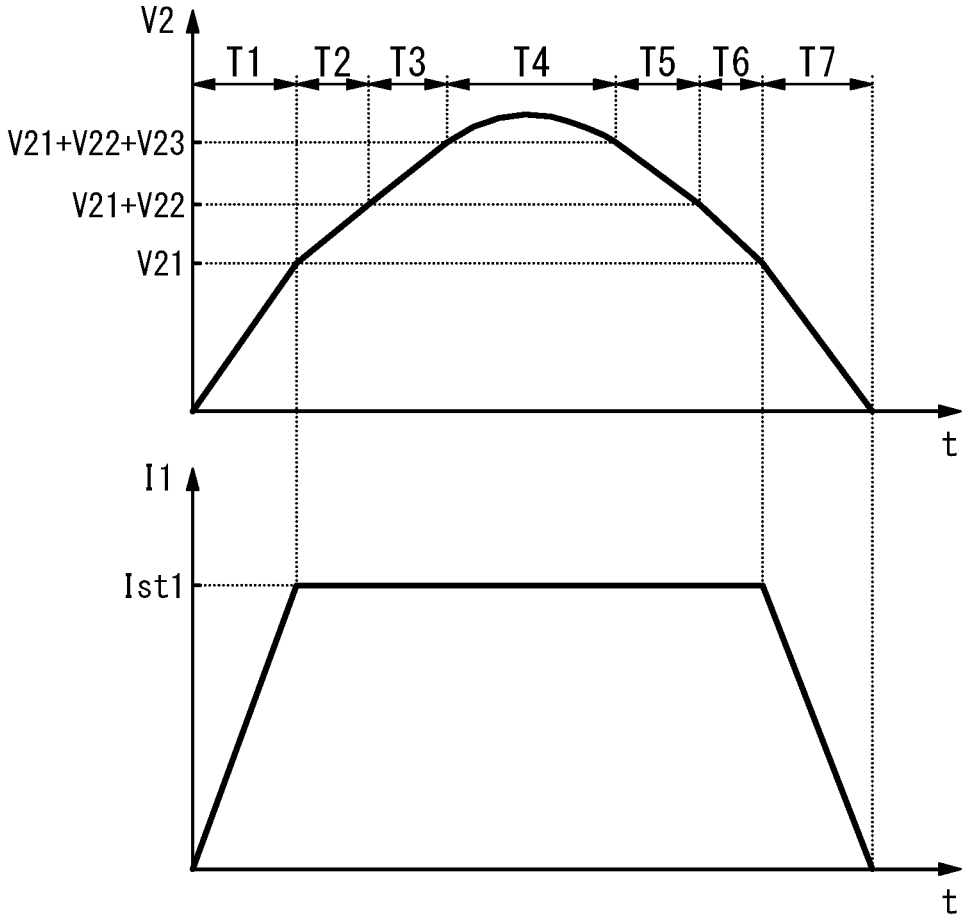
FIG. 2 is a waveform chart depicting a pulsating voltage and a current to be output from a rectifier circuit in the lighting device.
Figure 3A:
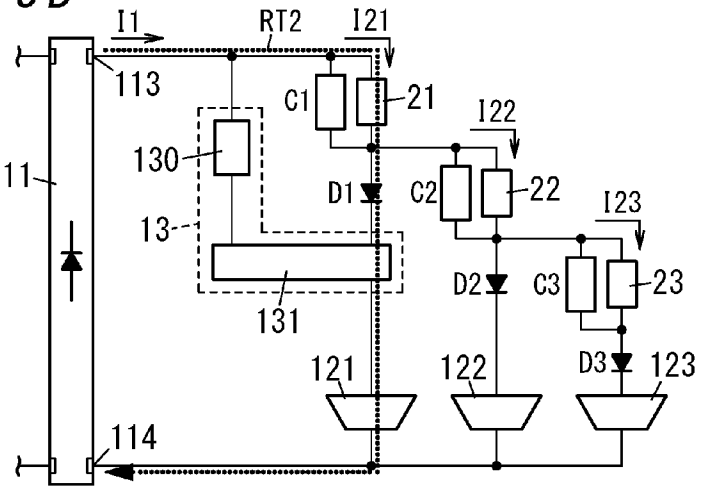

The first, second and third solid light sources 21, 22 and 23 are non-conductive and all of them are unlit while a value of the pulsating voltage V2 from the rectifier circuit 11 is less than the first ON voltage V21 (a period of time T1, T7 in FIG. 2). In this case, the second and third constant current circuits 122 and 123 stop operating. On the other hand, the control circuit 131 of the shunt circuit 13 operates to allow a current I1 from the rectifier circuit 11 to flow through the bleeder resistor 130. The current flowing through the bleeder resistor 130 flows into the input terminal of the first constant current circuit 121 via the control circuit 131. The first constant current circuit 121 operates accordingly. A current I20 (current I1) consequently flows through a path RT1 shown by a dotted line of FIG. 3A that starts from the first polarity output terminal 113 of the rectifier circuit 11 and returns to the second polarity output terminal 114 of the rectifier circuit 11 via the shunt circuit 13 and the first constant current circuit 121. Hereinafter, an operation mode when the current I1 flows through the path RT1 is referred to as a first mode. Here, the period of time while the value of the pulsating voltage V2 is less than the first ON voltage V21 is a first period of time while the current 120 flows through the shunt circuit 13.

Figure 3B:
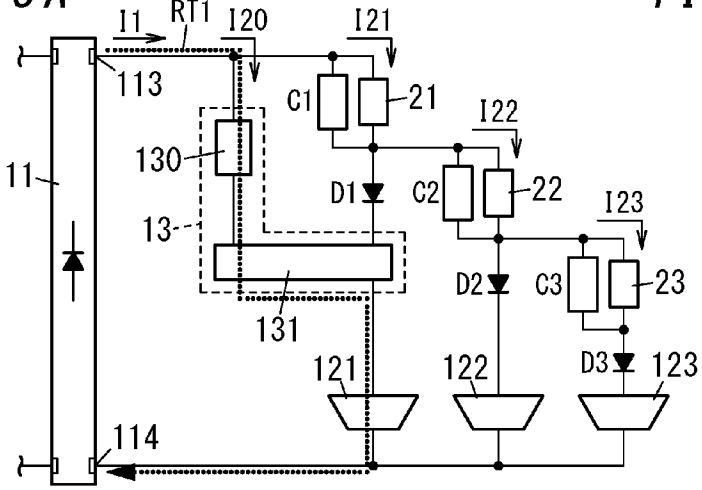

The first solid light source 21 and the first diode D1 conduct during a period of time (a period of time T2, T6 in FIG. 2) while the value of the pulsating voltage V2 is greater than or equal to the first ON voltage V21 and less than a total value of the first and second ON voltages V21 and V22 (hereinafter referred to as a "a first total voltage value"). If the first solid light source 21 and the first diode D1 conduct, the first constant current circuit 121 operates and then converts a current 121 (the current I1) flowing through the first solid light source 21 into a constant current. The first solid light source 21 is lit by the current I21 flowing therethrough. Note that the control circuit 131 of the shunt circuit 13 is configured to prohibit the current I1 from flowing through the bleeder resistor 130 after the current I21 begins to flow through the first solid light source 21. Consequently, during a period of time T2 or T6, the current I1 flows through a path RT2 shown by a dotted line of FIG. 3B that starts from the first polarity output terminal 113 of the rectifier circuit 11 and returns to the second polarity output terminal 114 of the rectifier circuit 11 via the first solid light source 21, the first diode D1, a resistor R4 of the shunt circuit 13 and the first constant current circuit 121. Note that the first constant current circuit 121 is configured to convert the current I21 flowing through the first solid light source 21 into a prescribed constant current value Ist1 (see FIG. 2). On the other hand, the second and third solid light sources 22 and 23 are non-conductive and remain unlit. Hereinafter, an operation mode when the current I1 (I21) flows through the path RT2 is referred to as a second mode. Here, the period of time while the value of the pulsating voltage V2 is greater than or equal to the first ON voltage V21 and less than the first total voltage value is a second period of time while the current I21 flows through only the first solid light source 21 of the solid light sources 20.

Figure 3C:
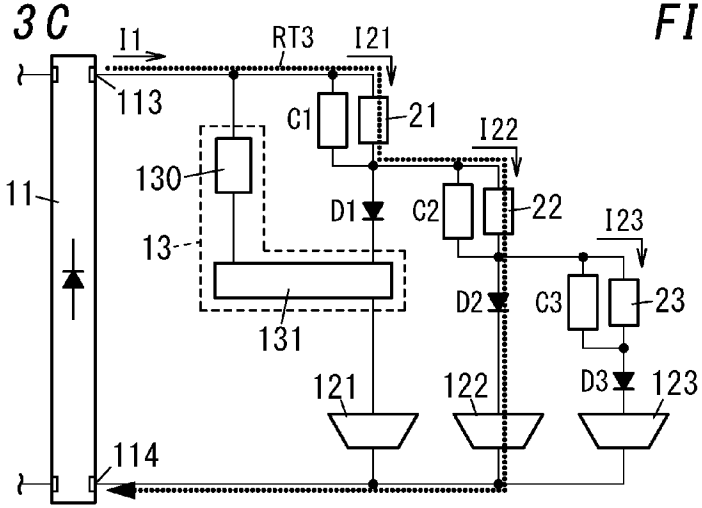

During a period of time T3 or T5 in FIG. 2, the value of the pulsating voltage V2 is greater than or equal to the first total voltage value (V21+V22) and less than a total value of the first total voltage value and the third ON voltage V23 (hereinafter referred to as a second total voltage value). The first and second solid light sources 21 and 22 and the second diode D2 conduct during a period of time T3 or T5. If the first and second solid light sources 21 and 22 and the second diode D2 conduct, the second constant current circuit 122 operates and then converts the currents I21, I22 (the current I1) flowing through the first and second solid light sources 21 and 22 into a constant current. The first and second solid light sources 21 and 22 are lit by the current I21, I22 flowing therethrough. Note that the first constant current circuit 121 stops operating. Consequently, the current I1 flows through a path RT3 shown by a dotted line of FIG. 3C that starts from the first polarity output terminal 113 of the rectifier circuit 11 and returns to the second polarity output terminal 114 of the rectifier circuit 11 via the first and second solid light sources 21 and 22, the second diode D2 and the second constant current circuit 122. Note that the second constant current circuit 122 is configured to convert the current 121 flowing through the first solid light source 21 and the current I22 flowing through the second solid light source 22 into the prescribed constant current Ist1 (see FIG. 2). On the other hand, the third solid light source 23 is non-conductive and remains unlit. Hereinafter, an operation mode when the current I1 (I21 and I22) flows through the path RT3 is referred to as a third mode.

During a period of time T4 in FIG. 2, the value of the pulsating voltage V2 is more than the second total voltage value (V21+V22+V23). The first, second and third solid light sources 21, 22 and 23 and the third diode D3 conduct during the period of time T4. If the first, second and third solid light sources 21, 22 and 23 and the third diode D3 conduct, the third constant current circuit 123 operates and then converts the current I21, I22, I23 flowing through the first, second and third solid light sources 21, 22 and 23 into the constant current. The first, second and third solid light sources 21, 22 and 23 are lit by the currents I21, I22, I23 flowing therethrough. Note that the first and second constant current circuits 121 and 122 stop operating. That is, the current I1 flows through a path RT4 shown by a dotted line of FIG. 3D. The path RT4 starts from the first polarity output terminal 113 of the rectifier circuit 11 and returns to the second polarity output terminal 114 of the rectifier circuit 11 via the first, second and third solid light sources 21, 22 and 23, the third diode D3 and the third constant current circuit 123. Note that the third constant current circuit 123 is configured to convert the current flowing through the first solid light source 21, the current I22 flowing through the second solid light source 22 and the current I23 flowing through the third solid light source 23 into the prescribed constant current Ist1 (see FIG. 2). Hereinafter, an operation mode when the current I1 (I21, I22 and I23) flows through the path RT4 is referred to as a fourth mode. Here, the period of time while the value of the pulsating voltage V2 is greater than or equal to the second total voltage value is a third period of time while every solid light source (the first, second and third solid light sources 21, 22 and 23) is lit.

A circuit configuration of the lighting device 1X is now explained in further detail with reference to FIG. 4. Note that the circuit configuration shown in FIG. 4 is just a circuit configuration example of the lighting device 1X. That is, the circuit configuration of the lighting device 1X is not limited to the circuit configuration shown in FIG. 4, but may be modified appropriately.

Each of the first, second and third solid light sources 21, 22 and 23 includes a solid light source device composed of a surface-mounted light emitting diode (first, second or third solid light source device 210, 220 or 230). Preferably, each of the first, second and third solid light sources 21, 22 and 23 is composed of a series circuit of solid light source devices (first, second or third solid light source devices 210, 220 or 230). Note that each of the first, second and third solid light source devices 210, 220 and 230 may be a solid light source device other than a light emitting diode, such as an organic electroluminescence element or a laser diode.

In the example, the first ON voltage V21 of the first solid light source 21 has a value obtained by multiplying a forward voltage of the first solid light source device 210 and the number of the first solid light source devices 210 connected in series. The second ON voltage V22 of the second solid light source 22 has a value obtained by multiplying a forward voltage of the second solid light source device 220 and the number of the second solid light source devices 220 connected in series. The third ON voltage V23 of the third solid light source 23 has a value obtained by multiplying a forward voltage of the third solid light source device 230 and the number of the third solid light source devices 230 connected in series. In an example in which every forward voltage of the first, second and third solid light source devices 210, 220 and 230 is 3.1[V], if the number of the first solid light source devices 210 constituting the first solid light source 21 is 14, the first ON voltage V21 is given by 43.4[V] (=3.1×14). If the number of the second solid light source devices 220 constituting the second solid light source 22 is 13, the second ON voltage V22 is given by 40.3[V] (=3.1×13). If the number of the third solid light source devices 230 constituting the third solid light source 23 is 12, the third ON voltage V23 is given by 37.2[V] (=3.1×12).

Each of the first, second and third capacitors C1, C2 and C3 connected one-to-one in parallel with the first, second and third solid light source devices 210, 220 and 230 is, for example an aluminum electrolytic capacitor. The first, second and third capacitors C1, C2 and C3 are configured to smooth their respective currents I21, I22 and I23, thereby reducing ripples (fluctuation) of each light output of the first, second and third solid light sources 21, 22 and 23. It is accordingly preferable that the capacitance of the first capacitor C1 be set so that a time constant determined by the equivalent resistance of the first solid light source 21 and the capacitance of the first capacitor C1 is larger than the period of the pulsating voltage V2. Similarly, the capacitance of the second capacitor C2 is preferably set so that a time constant determined by the equivalent resistance of the second solid light source 22 and the capacitance of the second capacitor C2 is larger than the period of the pulsating voltage V2. The capacitance of the third capacitor C3 is preferably set so that a time constant determined by the equivalent resistance of the third solid light source 23 and the capacitance of the third capacitor C3 is larger than the period of the pulsating voltage V2. However, the capacitors C1 to C3 are optional components of the lighting device 1X, and may be omitted appropriately.

The driver circuit 12 has a current control circuit 124 in addition to the first to third constant current circuits 121 to 123. Preferably, the current control circuit 124 is composed of a Zener diode 1240, a first voltage division resistor R101, a second voltage division resistor R102, a third voltage division resistor R103 and a capacitor C101. One end of the first voltage division resistor R101 is electrically connected to the first polarity output terminal 113 of the rectifier circuit 11. Another end of the first voltage division resistor R101 is electrically connected to one end of the second voltage division resistor R102 and a cathode of the Zener diode 1240. Another end of the second voltage division resistor R102 is electrically connected to one end of the third voltage division resistor R103. Another end of the third voltage division resistor R103 is electrically connected to an anode of the Zener diode 1240, the second polarity output terminal 114 of the rectifier circuit 11, and a first end of the resistor R1. The capacitor C101 is electrically connected in parallel with the third voltage division resistor R103.

In this example, a voltage divider circuit composed of the first, second and third voltage division resistors R101, R102 and R103 is configured to divide the pulsating voltage V2 through the first, second and third voltage division resistors R101, R102 and R103, thereby generating a reference voltage Vx. Note that the reference voltage Vx is limited (clamped) to a voltage obtained by dividing a Zener voltage of the Zener diode 1240 by the second and third voltage division resistors R102 and R103 during a period time while the pulsating voltage V2 is greater than or equal to the first ON voltage V21 (the period of time T2 to the period of time T6 in FIG. 2). On the other hand, the reference voltage Vx varies in proportion to the pulsating voltage V2 during a period of time while the pulsating voltage V2 is less than the first ON voltage V21 (a period of time T1 or T7 in FIG. 2). Note that the three voltage division resistors R101 to R103 and the capacitor C101 constitute a filter circuit. The filter circuit is configured to reduce noise (harmonic noise) from the AC power supply 4, thereby preventing the malfunction of the constant current circuits 121 to 123 due to the noise. It is however preferable that the time constant of the filter circuit be less than or equal to one millisecond in order to cause the reference voltage Vx to vary in proportion to the pulsating voltage V2 during a period of time T1 or T7 in the case where the power frequency of the AC power supply 4 is 50 [Hz] or 60 [Hz].

The first constant current circuit 121 may include a transistor Q1, an operational amplifier U1, a capacitor C11 and a resistor R12. The transistor Q1 is, for example an enhancement-mode N-channel MOSFET (Metal-Oxide-Semiconductor Field Effect Transistor). A drain of the transistor Q1 is electrically connected to the cathode of the first diode D1 via the resistor R4. A source of the transistor Q1 is electrically connected to a second end of the resistor R1. A gate of the transistor Q1 is electrically connected to an output terminal of the operational amplifier U1. A non-inverting input terminal of the operational amplifier U1 is electrically connected to a junction of the voltage division resistors R102 and R103. The non-inverting input terminal of the operational amplifier U1 is electrically connected to an output terminal of the current control circuit 124 (the junction of the second and third voltage division resistors R102 and R103). That is, the non-inverting input terminal of the operational amplifier U1 is supplied with the reference voltage Vx. An inverting input terminal of the operational amplifier U1 is electrically connected to the output terminal of the operational amplifier U1 via the capacitor C11. The inverting input terminal of the operational amplifier U1 is also electrically connected to the source of the transistor Q1 via the resistor R12. That is, the inverting input terminal of the operational amplifier U1 is supplied with a detection voltage Vy proportional to a current flowing through the resistor R1 (the current I1). The operational amplifier U1 is to supply the gate of the transistor Q1 with a voltage (an output voltage) proportional to a difference between the reference voltage Vx and the detection voltage Vy. The operational amplifier U1 is configured to decrease the output voltage if a value of the current I1 flowing through the resistor R1 is greater than a target value corresponding to a value of the reference voltage Vx, thereby decreasing a gate-source voltage of the transistor Q1 to decrease the current I1. The operational amplifier U1 is also configured to increase the output voltage if the value of the current I1 is less than the target value, thereby increasing the gate-source voltage of the transistor Q1 to increase the current 11. Thus, the operational amplifier U1 controls the transistor Q1 so that the current I1 flowing through the resistor R1 accords with the target value corresponding to the value of the reference voltage Vx. In the example, the capacitor C11 and the resistor R12 constitute a phase compensation circuit that prevents the oscillation of the operational amplifier U1.

Each of the second and third constant current circuits 122 and 123 has the same circuit configuration as the first constant current circuit 121. That is, a transistor Q2, an operational amplifier U2, a capacitor C21 and a resistor R22 of the second constant current circuit 122 correspond to the transistor Q1, the operational amplifier U1, the capacitor C11 and the resistor R12 of the first constant current circuit 121, respectively. Similarly, a transistor Q3, an operational amplifier U3, a capacitor C31 and a resistor R32 of the third constant current circuit 123 correspond to the transistor Q1, the operational amplifier U1, the capacitor C11 and the resistor R12 of the first constant current circuit 121, respectively. Each of the second and third constant current circuits 122 and 123 is to operate so that the current I1 flowing through the resistor R1 accords with a target value corresponding to a value of the reference voltage Vx, like the first constant current circuit 121. Note that if the second and third solid light sources 22 and 23 do not conduct, the second and third constant current circuits 122 and 123 are prohibited from operating, respectively. It is preferable that the first constant current circuit 121 cut off or decrease a drain current of the transistor Q1 while the second constant current circuit 122 is operating. It is also preferable that the second constant current circuit 122 cut off or decrease a drain current of the transistor Q2 while the third constant current circuit 123 is operating.

A circuit configuration of the shunt circuit 13 is now explained. As stated above, the shunt circuit 13 includes the bleeder resistor 130 and the control circuit 131. The first end of the bleeder resistor 130 is electrically connected to the first polarity output terminal 113 of the rectifier circuit 11. The control circuit 131 includes three switching (switch) devices Q4, Q5 and Q6 and three resistors R2, R3 and R4. Each of the three switching devices Q4, Q5 and Q6 may be an NPN bipolar transistor. A collector of the switching device Q4 is electrically connected to a second end of the bleeder resistor 130. An emitter of the switching device Q4 is electrically connected to one end of the resistor R2 and a base of the switching device Q5. Another end of the resistor R2 is electrically connected to an emitter of the switching device Q5 and an emitter of the switching device Q6. A collector of the switching device Q5 is electrically connected to the first end of the bleeder resistor 130 and the first polarity output terminal 113 of the rectifier circuit 11, via the resistor R3. A collector of the switching device Q6 is electrically connected to a base of the switching device Q4 and the collector of the switching device Q5. A base of the switching device Q6 is electrically connected to the cathode of the first diode D1 and one end of the resistor R4. The emitter of the switching device Q6 is electrically connected to another end of the resistor R4 and the drain of the transistor Q1 in the first constant current circuit 121. The control circuit 131 is configured to turn the switching device Q4 on, thereby allowing a current to flow through the bleeder resistor 130. The control circuit 131 is also configured to turn the switching device Q6 on while the current I1 flows through the resistor R4 with the first solid light source 21 and the first diode D1 conducting, thereby turning the switching device Q4 off to prohibit the current from flowing through the bleeder resistor 130. The control circuit 131 is further configured to turn the switching device Q5 on when the current flowing through the bleeder resistor 130 increases excessively, thereby turning the switching device Q4 off. In short, the control circuit 131 is configured to: allow a current to flow through the bleeder resistor 130 during a period of time while the value of the pulsating voltage V2 is less than the first ON voltage V21; and prohibit the current from flowing through the bleeder resistor 130 other than during the period of time.

Figure 6:
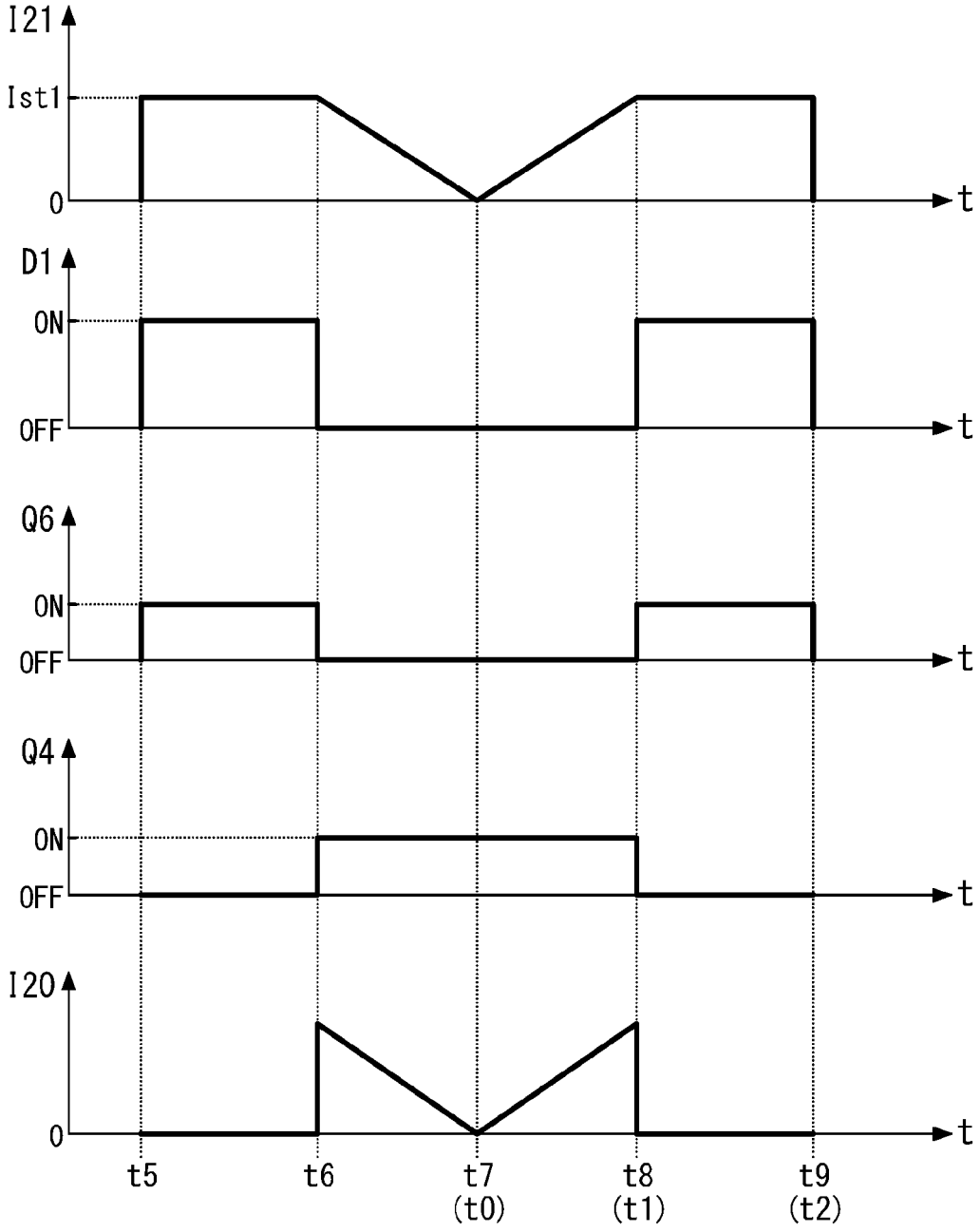
FIG. 6 shows waveforms illustrating operations of a shunt circuit in the lighting device.

The operations of the lighting device 1X are explained with reference to FIGS. 5 and 6. FIG. 5 shows waveforms illustrating operations of the lighting device 1X. FIG. 5 shows respective waveforms of the pulsating voltage V2, the current I1 the current I20, the current I21, the current I22 and the current I23 from the top. FIG. 6 shows waveforms illustrating operations of the shunt circuit 13. FIG. 6 shows a waveform of the current I21, an ON/OFF(conductive/non-conductive) state of the first diode D1, an ON/OFF state of the switching device Q6, an ON/OFF state of the switching device Q4 and a waveform of the current I20 from the top. In FIGS. 5 and 6, each horizontal axis represents time "t", and a time t=t0, t7 corresponds to a zero cross of the pulsating voltage V2.

During a period of time t=t0 to t1, the value of the pulsating voltage V2 is less than the first ON voltage V21, and therefore all of the first, second and third solid light sources 21, 22 and 23 are unlit. While the value of the pulsating voltage V2 is less than the first ON voltage V21, the first solid light source 21 and the first diode D1 do not conduct (turn on). The switching device Q6 accordingly turns off because no current therefore flows through the resistor R4. In this case, the switching device Q4 turns on, and therefore the current 120 (current I1) flows through a path of the bleeder resistor 130, the switching device Q4, the resistor R2 and the first constant current circuit 121, from the first polarity output terminal 113 of the rectifier circuit 11. The first constant current circuit 121 causes the current 120 (current I1) flowing through the shunt circuit 13 to accord with the target value corresponding to the value of the reference voltage Vx. Note that during the period of time t=t0 to t1, since the reference voltage Vx from the current control circuit 124 increases in proportion to the pulsating voltage V2, the current I20 (current I1) also increases gradually.

During a period of time t=t1 to t2, since the value of the pulsating voltage V2 is greater than or equal to the first ON voltage V21 and less than the first total voltage value, the first solid light source 21 and the first diode D1 conduct (turn on). The current 121 (current I1) accordingly flows through the resistor R4. When the current flows through the resistor R4, the switching device Q6 turns on. When the switching device Q6 turns on, the switching device Q4 turns off and the current I20 is therefore prohibited from flowing through the bleeder resistor 130. The first constant current circuit 121 causes the current I21 (current I1) flowing through the first solid light source 21 and the first diode D1 to accord with the target value corresponding to the value of the reference voltage Vx. Note that during a period of time t=t1 to t6, the reference voltage Vx from the current control circuit 124 is limited (clamped) to a voltage obtained by dividing the Zener voltage of the Zener diode 1240 by the second and third voltage division resistor R102 and R103. Therefore, the current I21 (current I1) is converted into the prescribed current value Ist1.

During a period of time t=t2 to t3, since the value of the pulsating voltage V2 is greater than or equal to the first total voltage value and less than the second total voltage value, the first and second solid light source 21 and 22 and the second diode D2 conduct (turn on) and the first diode D1 is non-conductive (turns off). When the first diode D1 turns off, the switching device Q6 turns off because the current I21 (current I1) stops flowing through the resistor R4. Note that even when the switching device Q6 turns off, the switching device Q4 remains to be turned off because no current (current I20) flows towards the shunt circuit 13 while the first solid light source 21 is lit. In this moment, the first constant current circuit 121 stops operating. The second constant current circuit 122 also converts the current I22 (current I1) flowing through the first and second solid light sources 21 and 22 and the second diode D2 into the prescribed constant current Ist1.

Figure 3D:
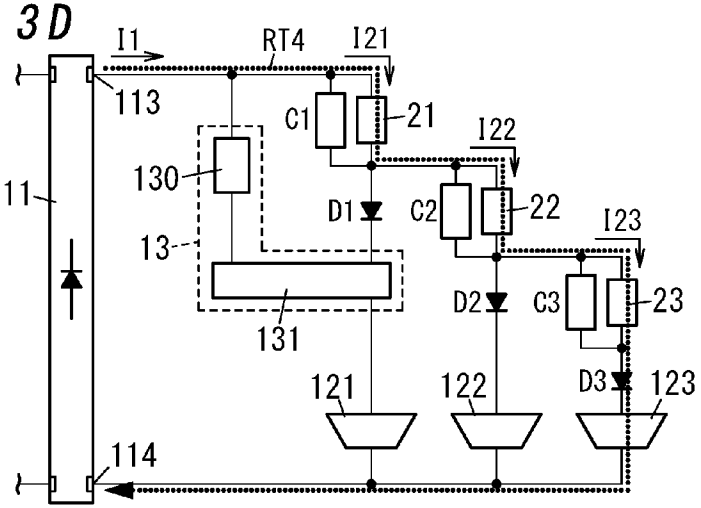

During a period of time t=t3 to t4, since the value of the pulsating voltage V2 is greater than the second total voltage value, the first, second and third solid light sources 21, 22 and 23 and the third diode D3 conduct (turn on). The first and second diodes D1 and D2 become also non-conductive (turn off). Although the first diode turns off, the shunt circuit 13 remains to be stopped. The first and second constant current circuits 121 and 122 stop operating. The third constant current circuit 123 converts the current I23 (current I1) flowing through the first, second and third solid light sources 21, 22 and 23 and the third diode D3 into the prescribed constant current Ist1. Note that as shown in FIG. 3D the current flowing through the third solid light source 23 is assigned 123 in order to be distinguished from the current I21 shown in FIGS. 3B and 5 and the current I22(I21) shown in FIGS. 3C and 5. That is, as can been seen from Ist1 of FIG. 5, the current flowing through first solid light source 21 as the current I21 shown in FIG. 3D is equal to each of the current I21 shown in FIG. 3B and the current I21 shown in FIG. 3C. Similarly, the current flowing through second solid light source 22 as the current I22 shown in FIG. 3D is equal to the current I22 shown in FIG. 3C.

During a period of time t=t4 to t5, since the value of the pulsating voltage V2 is greater than or equal to the first total voltage value and less than the second total voltage value, the third solid light source 23 and the third diode D3 become non-conductive (turn off). The first and second solid light sources 21 and 22 and the second diode D2 conduct (turn on), while the first diode D1 remains to be non-conductive (turned off). Although the first diode D1 is in an OFF state, the shunt circuit 13 remains to be stopped. The third constant current circuit 123 stops operating. The second constant current circuit 122 also converts the current I22 (current I1) flowing through the first and second solid light sources 21 and 22 and the second diode D2 into the prescribed constant current Ist1.

During a period of time t=t5 to t6, since the value of the pulsating voltage V2 is greater than or equal to the first ON voltage V21 and less than the first total voltage value, the second and third solid light sources 22 and 23 and the second and third diodes D2 and D3 become non-conduct (turn off). The first solid light source 21 and the first diode D1 also conduct (turn on). When the diode D1 turns on, the switching device Q4 turns off. The shunt circuit 13 therefore remains to be stopped. The second constant current circuit 122 also stops operating. The first constant current circuit 121 converts the current I21 (current I1) flowing through the first solid light source 21 and the first diode D1 into the prescribed constant current Ist1.

During a period of time t=t6 to t7, since the value of the pulsating voltage V2 is less than the first ON voltage V21, the first, second and third solid light sources 21, 22 and 23 and the first, second and third diodes D1, D2 and D3 become non-conduct (turn off). Since the first diode D1 turns off, the switching device Q4 turns on and the control circuit 131 operates to allow the current I20 to flow through the bleeder resistor 130. The second and third constant current circuits 122 and 123 remain to be stopped. The first constant current circuit 121 causes the current I20 (current I1) flowing the shunt circuit 13 to accord with the target value corresponding to the reference voltage Vx. Note that during the period of time t=t6 to t7, the current I20 (current I1) gradually decreases because the reference voltage Vx from the current control circuit 124 decreases in proportion to the pulsating voltage V2.

Subsequently, the lighting device 1X repeats the operations from time t0 to time t7 every half period of the AC voltage V1 (one period of the pulsating voltage V2).

As stated above, the lighting device 1X causes the current I20 to flow through the shunt circuit 13 during a period of time (a first period of time) while all the first, second and third solid light sources 21, 22 and 23 are unlit, thereby removing a period of time in which no input current (current I1) flows into the lighting device 1X from the AC power supply 4. The lighting device 1X can consequently reduce the harmonic distortion of the input current (current I1).

The advantage of the configuration in which the shunt circuit 13 is electrically connected in parallel with the first solid light source 21 is now explained. The pulsating voltage V2 across the first polarity and second polarity output terminals 113 and 114 reaches a peak value of AC voltage V1 as a maximum value (about 141 [V] when the effective value is 100 [V]). Therefore, the parallel electrical connection of the shunt circuit 13 with the first polarity and second polarity output terminals 113 and 114 causes the switching device Q4 of the control circuit 131 requiring a withstand voltage greater than the maximum value of the pulsating voltage V2 (about 141 [V]).

On the other hand, the shunt circuit 13 is electrically connected in parallel with the first solid light source 21 (the first solid light source 21 and the first diode D1 in the example of FIG. 1). The switching device Q4 of the control circuit 131 is therefore to be supplied with a forward voltage (the first ON voltage V21) of the first solid light source 21 as a maximum voltage (e.g., about 43 [V]). Therefore, enough withstand voltage for the switching device Q4 is about 80 [V] at most. A semiconductor switching (switch) device with enough lower withstand voltage than the maximum voltage of the pulsating voltage V2 (about 141 [V]) can be accordingly employed as the switching device Q4, thereby suppressing a rise in production cost.

As stated above, the lighting device 1X includes the rectifier circuit 11, the driver circuit 12 and the shunt circuit 13. The rectifier circuit 11 includes the first polarity and second polarity output terminals 113 and 114. The rectifier circuit 11 is configured to output, from the first polarity and second polarity output terminals 113 and 114, the pulsating voltage V2 obtained by rectifying the AC voltage V1. The driver circuit 12 is configured to, in response to a value of the pulsating voltage V2 within one period of the pulsating voltage V2, switch sequentially in time between a first period of time, a second period of time, a third period of time, the second period of time and the first period of time. The first period of time is a period of time while the shunt circuit 13 is supplied with the output current I1 from the first polarity output terminal 113. The second period of time is a period of time while the first solid light source 21 is supplied with the output current I1. The third period of time is a period of time while the solid light sources including the first solid light source 21 (the first, second and third solid light sources 21, 22 and 23) are supplied with the output current IL The shunt circuit 13 is electrically connected in parallel with the first solid light source 21. The shunt circuit 13 is configured to allow the output current I1 proportional to a value of the pulsating voltage V2 to flow through during the first period of time.

With the aforementioned configuration of the lighting device 1X, it is possible to relatively reduce the withstand voltage of a circuit component of the shunt circuit 13 because the maximum voltage of the pulsating voltage V2 to be supplied across the shunt circuit 13 is about the forward voltage of the first solid light source 21. The lighting device 1X causes a current to flow through the shunt circuit 13, thereby enabling reduction in harmonic distortion of the input current I1. Employing the circuit component with a low withstand voltage enables the suppression of production cost.

Preferably, the lighting device 1X includes capacitors (the first, second and third capacitors C1, C2 and C3) corresponding one-to-one to the solid light sources (the first, second and third solid light sources 21, 22 and 23). Each of the capacitors (the first, second and third capacitors C1, C2 and C3) is electrically connected in parallel with a corresponding solid light source of the solid light sources (the first, second and third solid light sources 21, 22 and 23).

With the aforementioned configuration of the lighting device 1X, it is possible to smooth the voltage applied across the solid light sources according to variation of the pulsating voltage V2 to suppress fluctuation (ripples) of a light output of the solid light sources.

In the lighting device 1X, preferably the shunt circuit 13 is configured to limit the value of the output current I1 flowing during the first period of time to a prescribed upper limit or less.

With the aforementioned configuration of the lighting device 1X, it is possible to prevent an over-current from flowing through a circuit component (the switching device Q4) of the shunt circuit 13.

Figure 7:
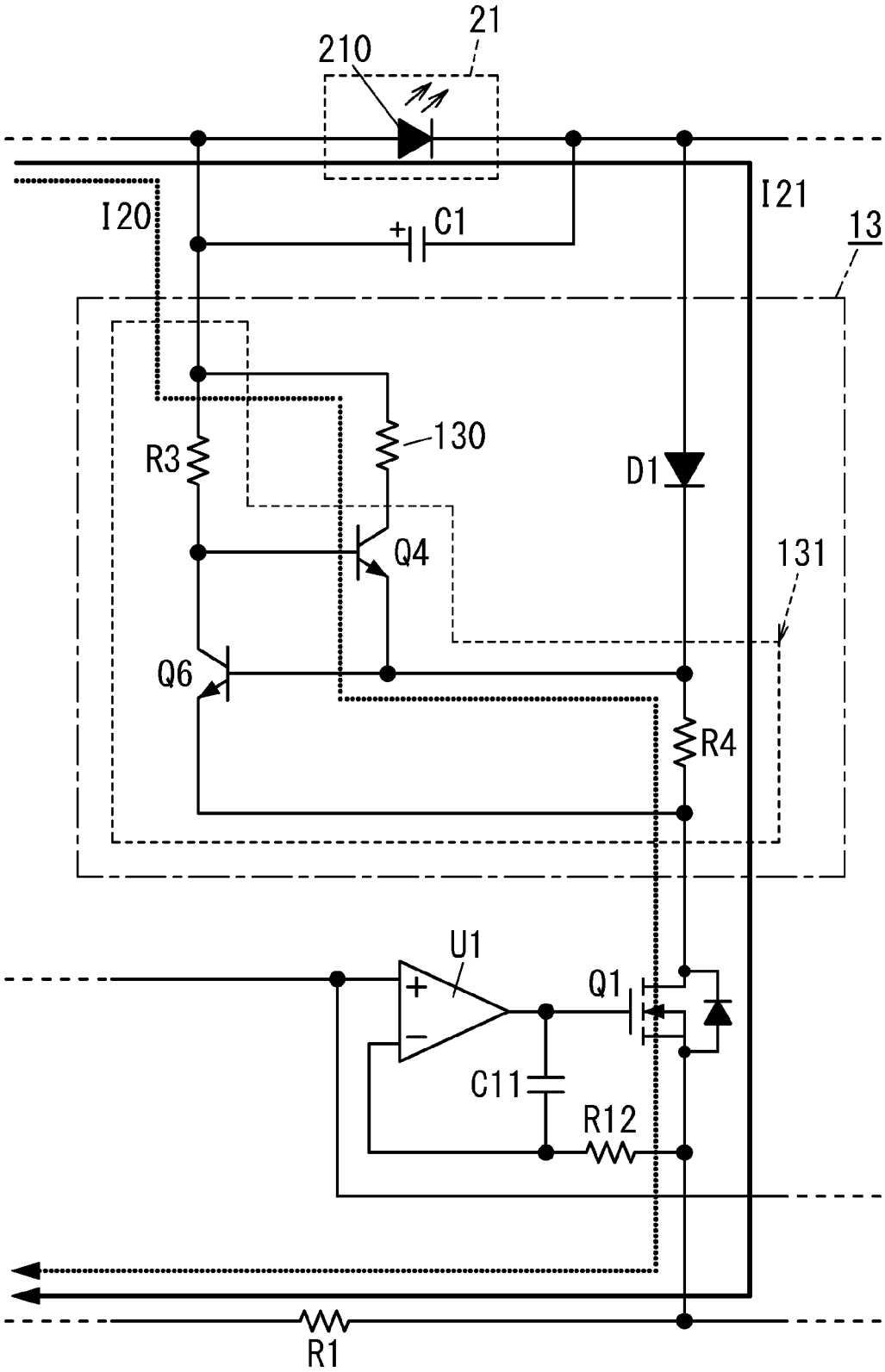
FIG. 7 is a circuit diagram showing another configuration example of the shunt circuit in the lighting device.

Incidentally, the shunt circuit 13 may include a control circuit 131 configured as shown in FIG. 7. The control circuit 131 shown in FIG. 7 includes two switching devices Q4 and Q6 and two resistors R3 and R4. A first end of a bleeder resistor 130 and one end of the resistor R3 are electrically connected to a positive electrode of a first solid light source 21. A second end of the bleeder resistor 130 is electrically connected to a collector of the switching device Q4. Another end of the resistor R3 is electrically connected to a base of the switching device Q4 and a collector of the switching device Q6. An emitter of the switching device Q4 and a base of the switching device Q6 are electrically connected to one end of the resistor R4 and a cathode of a first diode D1. An emitter of the switching device Q6 is electrically connected to another end of the resistor R4 and a drain of a transistor Q1.

The control circuit 131 is configured to turn the switching device Q4 on, thereby allowing a current 120 to flow through the bleeder resistor 130. The control circuit 131 is configured to turn the switching device Q6 on when a current I21 flows through the resistor R4 as a result of conduction of the first solid light source 21 and the first diode D1 and then a voltage across the resistor R4 exceeds a threshold of a base-emitter voltage of the switching device Q6. The control circuit 131 turns the switching device Q6 on, thereby turning the switching device Q4 off to prohibit a current from flowing through the bleeder resistor 130. The control circuit 131 is configured to turn the switching device Q6 on when the current flowing through the bleeder resistor 130 increases excessively, thereby turning the switching device Q4 off. That is, the control circuit 131 is configured to allow a current to flow through the bleeder resistor 130 during a period of time while a value of a pulsating voltage V2 is less than a first ON voltage V21, and prohibit the current from flowing through the bleeder resistor 130 other than during the period of time.

With the aforementioned configuration of the control circuit 131, it is possible to omit the switching device Q5 and the resistor R5 and also allow the current 120 to flow through the bleeder resistor 130 only during the first period of time.

Embodiment 2

Figure 8:
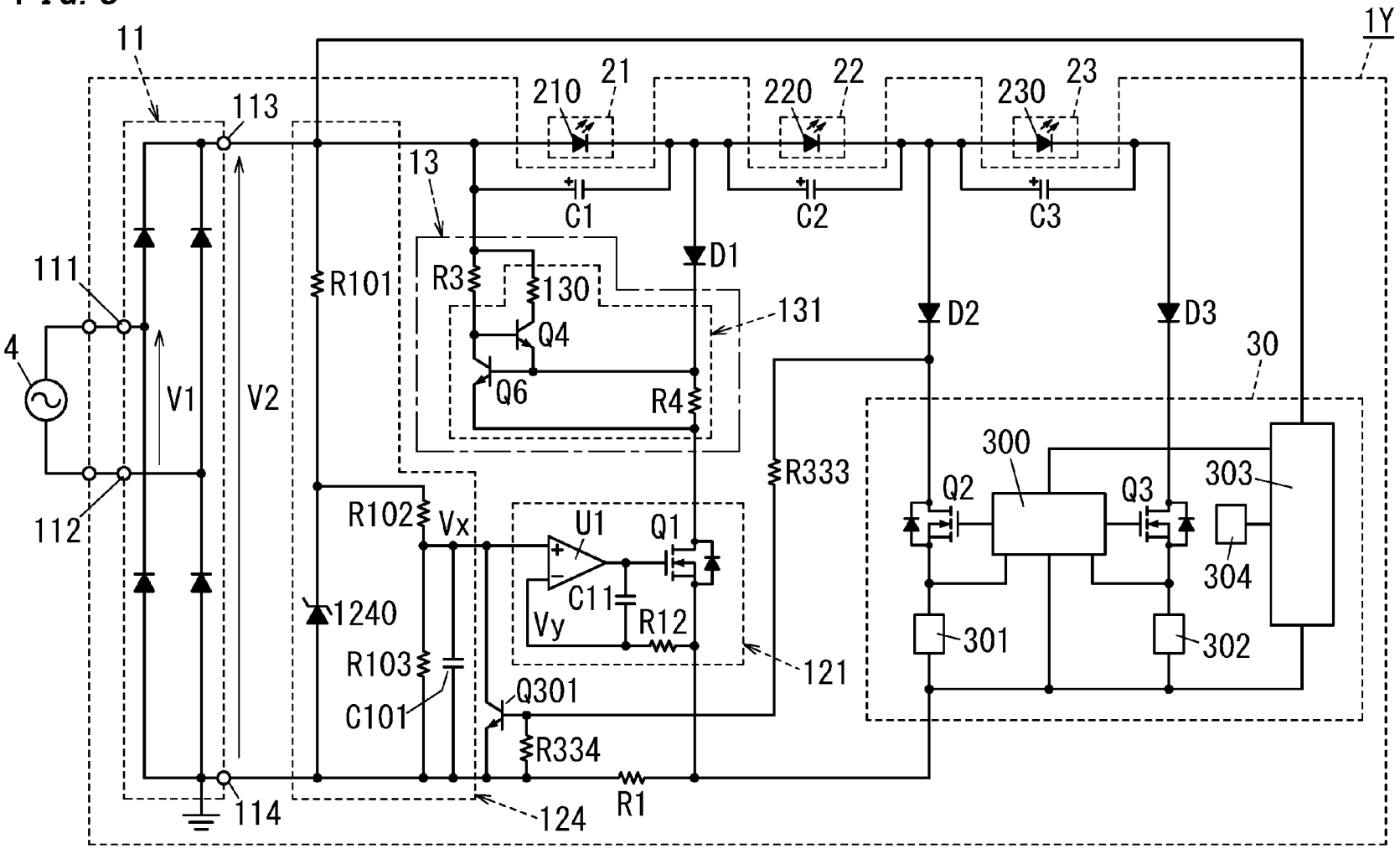
FIG. 8 is a circuit diagram of a lighting device in accordance with Embodiment 2.

FIG. 8 shows a circuit configuration of a lighting device 1Y according to Embodiment 2. Note that since the circuit configuration of the lighting device 1Y is mostly common to the circuit configuration of the lighting device 1X shown in FIG. 4, identical constituent elements to those of the lighting device 1X have been allocated identical reference numerals, and description thereof has been omitted as appropriate.

The lighting device 1Y differs from the lighting device 1X in that it includes an integrated circuit (a first integrated circuit 30) as second and third constant current circuits, and a circuit (a shut-down circuit) configured to forcibly deactivate a first constant current circuit 121. The lighting device 1Y also differs from the lighting device 1X in that a shunt circuit 13 includes a control circuit 131 as shown in FIG. 7.

The first integrated circuit 30 includes transistors Q2 and Q3, a controller 300 configured to control the transistors Q2 and Q3, first and second current sensors 301 and 302, a control power supply 303 and a thermal sensor 304.

The first current sensor 301 is configured to detect (measure) a value of a current I22 flowing through the transistor Q2. The second current sensor 302 is configured to detect (measure) a value of a current I23 flowing through the transistor Q3. The controller 300 is configured to control a source-gate voltage of the transistor Q2 so that a current value detected through the first current sensor 301 accords with a target value (e.g., a prescribed current value Ist1). The controller 300 is also configured to control a gate-source voltage of the transistor Q3 so that a current value detected through the second current sensor 302 accords with the target value (e.g., the prescribed current value Ist1). The thermal sensor 304 is configured to detect (measure) an internal temperature of the first integrated circuit 30. The control power supply 303 is configured to step-down and convert a pulsating voltage V2 from first polarity and second polarity output terminals 113 and 114 of a rectifier circuit 11 into a constant voltage to generate a control voltage. The control power supply 303 is also configured to supply the control voltage to the controller 300, the first and second current sensors 301 and 302, and the like. The control power supply 303 is configured to compare the internal temperature detected through the thermal sensor 304 with a first threshold and stop supplying the control voltage when the internal temperature exceeds the first threshold. Therefore, when supplying the control voltage is stopped, the controller 300 stops operating. The transistors Q2 and Q3 accordingly turn off because each gate-source voltage of the transistors Q2 and Q3 becomes zero. It is consequently possible to suppress the increase in the internal temperature of the first integrated circuit 30. Note that the control power supply 303 is configured to resume supplying the control voltage when the internal temperature detected through the thermal sensor 304 is below a second threshold lower than the first threshold.

The shut-down circuit is composed of a switching (switch) device Q301 and resistors R333 and R334. The switching device Q301 is, for example an NPN bipolar transistor. A collector of the switching device Q301 is electrically connected to a non-inverting input terminal of an operational amplifier U1. An emitter of the switching device Q301 is electrically connected to the second polarity output terminal 114 of the rectifier circuit 11. A base of the switching device Q301 is electrically connected to one end of the resistor R333 and one end of the resistor R334. Another end of the resistor R333 is electrically connected to a cathode of a second diode D2. Another end of the resistor R334 is electrically connected to the second polarity output terminal 114 of the rectifier circuit 11 and the emitter of the switching device Q301. When the second diode D2 conducts (turns on) and a current then flows through the resistors R333 and R334, a base-emitter voltage of the switching device Q301 increases and the switching device Q301 then turns on. When the switching device Q301 turns on, the transistor Q1 turns off because a reference voltage Vx to the non-inverting input terminal of the operational amplifier U1 becomes almost zero. The first constant current circuit 121 consequently stops operating. On the other hand, when the second diode D2 is non-conductive (turns off), the base-emitter voltage of the switching device Q301 decreases and the switching device Q301 then turns off.

As stated above, the lighting device 1Y is configured to forcibly deactivate the first constant current circuit 121 when the first integrated circuit 30 stops operating due to an abnormal rise in temperature of the first integrated circuit 30 or when the first integrated circuit 30 malfunctions. The lighting device 1Y can accordingly suppress the occurrence of malfunction caused by a continuous operation of the first constant current circuit 121.

Figure 9:
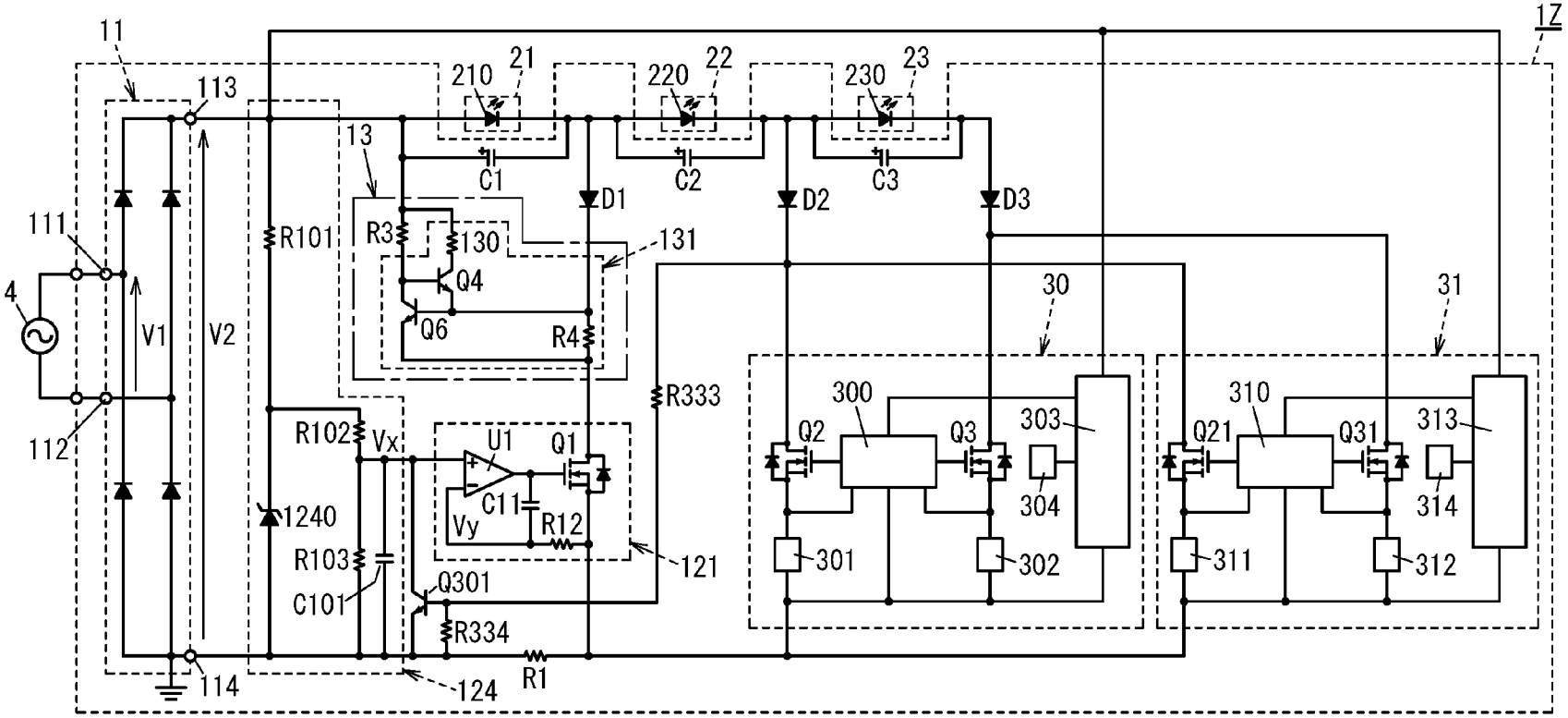
FIG. 9 is a circuit diagram of a modified example of the lighting device.

FIG. 9 shows a circuit configuration of a lighting device 1Z as a modified example of the lighting device 1Y. The lighting device 1Z differs from the lighting device 1Y in that it includes a second integrated circuit 31 in addition to a first integrated circuit 30.

The second integrated circuit 31 includes transistors Q21 and Q31, a controller 310 configured to control the transistors Q21 and Q31, first and second current sensors 311 and 312, a control power supply 313 and a thermal sensor 314. In short, the second integrated circuit 31 has a circuit configuration that is the same as that of the first integrated circuit 30.

The first current sensor 311 is configured to detect (measure) a value of a current 122 flowing through the transistor Q21. A series circuit of the transistor Q21 and the first current sensor 311 is electrically connected in parallel with a series circuit of a transistor Q2 and a first current sensor 301 in the first integrated circuit 30. The second current sensor 312 is configured to detect (measure) a value of a current I23 flowing through the transistor Q31. A series circuit of the transistor Q31 and the second current sensor 312 is electrically connected in parallel with a series circuit of a transistor Q3 and a second current sensor 302 in the first integrated circuit 30. The controller 310 is configured to control a gate-source voltage of the transistor Q21 so that a current value detected through the first current sensor 311 accords with a target value (e.g., a prescribed current value Ist1). The controller 310 is also configured to control a gate-source voltage of the transistor Q31 so that a current value detected through the second current sensor 312 accords with the target value (e.g., the prescribed current value Ist1). The thermal sensor 314 is configured to detect (measure) an internal temperature of the second integrated circuit 31. The control power supply 313 is configured to step-down and convert a pulsating voltage V2 from first polarity and second polarity output terminals 113 and 114 of a rectifier circuit 11 into a constant voltage to generate a control voltage. The control power supply 313 is also configured to supply the control voltage to the controller 310, the first and second current sensors 311 and 312, and the like. The control power supply 313 is configured to compare the internal temperature detected through the thermal sensor 314 with a first threshold and stop supplying the control voltage when the internal temperature exceeds the first threshold. Therefore, when supplying the control voltage is stopped, the controller 310 stops operating. The transistors Q21 and Q31 accordingly turn off because each gate-source voltage of the transistors Q21 and Q31 becomes zero. It is consequently possible to suppress the increase in the internal temperature of the second integrated circuit 31. Note that the control power supply 313 is configured to resume supplying the control voltage when the internal temperature detected through the thermal sensor 314 is below a second threshold lower than the first threshold.

With the lighting device 1Z, respective control of the currents 122 and 123 flowing through the second and third solid light sources 22 and 23 can be shared between the two integrated circuits 30 and 31. It is accordingly possible to suppress the increase in respective temperatures of the first and second integrated circuits 30 and 31. In the lighting device 1Z, the respective control of the currents are shared between the two integrated circuits 30 and 31, thereby enabling an increase in output and the suppression of cost rise in comparison with a circuit configuration in which one integrated circuit (first integrated circuit 30) performs current flow control.

Embodiment 3

Hereinafter, lighting equipment according to Embodiment 3 will be explained in detail.

Figure 10C:
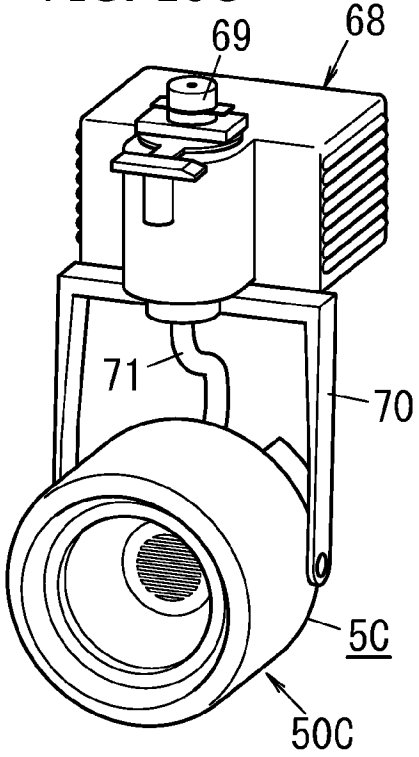
Figure 10B:
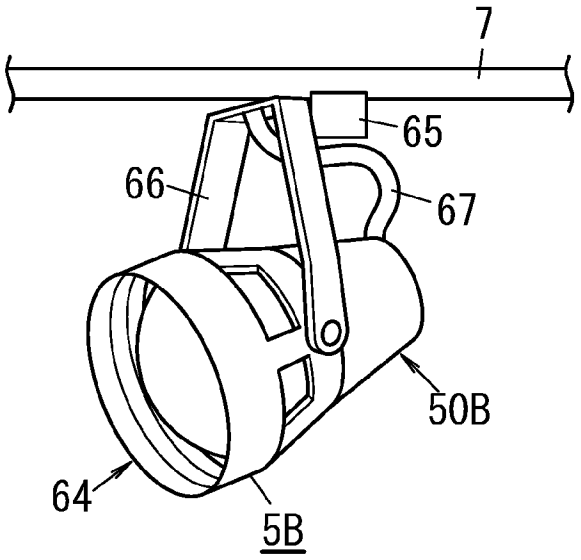
Figure 10A:
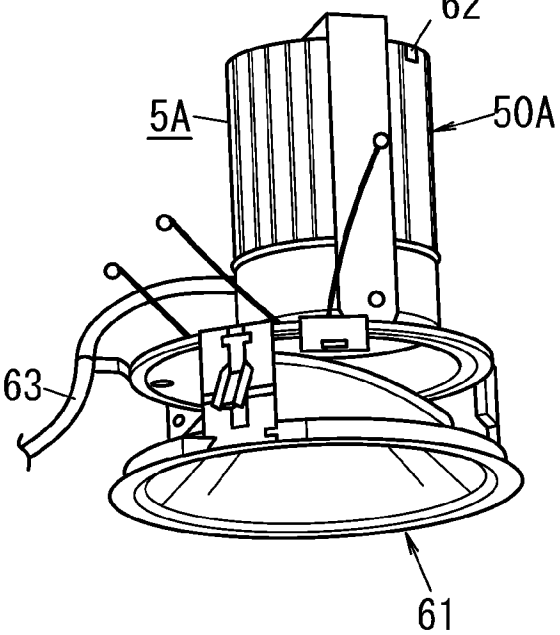

FIG. 10A is a perspective view of lighting equipment 5A according to the embodiment.

The lighting equipment 5A includes a lighting device of the aforementioned lighting devices 1X, 1Y and 1Z, and a body 50A that houses the lighting device.

The lighting equipment 5A is, for example a down light configured to be recessed into a ceiling. The lighting equipment 5A includes: the body 50 A that houses first, second and third solid light sources 21, 22 and 23 and the lighting device; and a reflector 61. The body 50 A includes a heat sink 62 with radiation fins in an upper part thereof. The lighting equipment 5A further includes a power cord 63 fixed from the body 50A. The power cord 63 is used to electrically connect the lighting device in the body 50A and an AC power supply 4.

The lighting equipment is not limited to the down light, but may be another type of lighting equipment such as a spot light.

FIGS. 10B and 10C show two pieces of lighting equipment 5B and 5C as spot lights configured to be attached to wire ducts 7.

That is, FIG. 10B shows the lighting equipment 5B as Modified Example 1, and FIG. 10C shows the lighting equipment 5C as Modified Example 2.

As shown in FIG. 10B, the lighting equipment 5B of Modified Example 1 includes a body 50B, a reflector 64, a connector 65 and an arm 66. The body 50B houses first, second and third solid light sources 21, 22 and 23, and a lighting device. The connector 65 is configured to be attached to the wire duct 7. The arm 66 is connected the connector 65 and the body 50B. The lighting device in the body 50B and the connector 65 are connected via a power cord 67.

As shown in FIG. 10C, the lighting equipment 5C of Modified Example 2 includes a body 50C, a box 68, a linkage 70 and a power cord 71. The body 50C houses first, second and third solid light sources 21, 22 and 23. The box 68 houses a lighting device. The linkage 70 links the body 50C with the box 68. The power cord 71 electrically connects the first, second and third solid light sources 21, 22 and 23 in the body 50C and the lighting device in the box 68. Note that a connector 69 is provided on an upper surface of the box 68 and configured to be detachably attached to and electrically and mechanically connected to the wire duct 7.

As stated above, lighting equipment (lighting equipment 5A, 5B or 5C) includes a lighting device (a lighting device 1X, by or 1Z) and a body (a body 50A, 50B or 50C) that holds the lighting device.

Since the aforementioned lighting equipment includes a lighting device (a lighting device 1X, by or 1Z), it is possible to reduce harmonic distortion of an input current I1 and suppress a rise in production cost.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

The invention claimed is:

1. A lighting device, comprising:

a rectifier circuit that includes a first polarity output terminal and a second polarity output terminal and that is configured to output, from the first polarity and second polarity output terminals, a pulsating voltage obtained by rectifying an AC voltage;

a driver circuit configured to apply respective voltage components contained in the pulsating voltage every period of the pulsating voltage across part and all of solid light sources in response to the pulsating voltage and respective ON voltages of light source circuits including the part and all of the solid light sources; and a shunt circuit that is electrically connected in parallel with a light source circuit having a lowest ON voltage of the light source circuits, and that is configured to set a value of an output current from the rectifier circuit to a value proportional to a value of the pulsating voltage while the pulsating voltage is less than the lowest ON voltage.

2. The lighting device of claim 1, wherein the driver circuit is configured to, in response to a value of the pulsating voltage within one period of the pulsating voltage, switch sequentially in time between:

a first period of time while the shunt circuit is supplied with the output current from the first polarity output terminal;

a second period of time while a first solid light source of the solid light sources is supplied with the output current;

a third period of time while solid light sources including the first solid light source are supplied with the output current, the second period of time while the first solid light source of the solid light sources is supplied with the output current; and the first period of time while the shunt circuit is supplied with the output current from the first polarity output terminal, and the shunt circuit is configured to set the value of the output current flowing during the first period of time to the value proportional to the value of the pulsating voltage.

3. The lighting device of claim 2, further comprising capacitors corresponding one-to-one to the solid light sources, each of the capacitors being electrically connected in parallel with a corresponding solid light source of the solid light sources.

4. The lighting device of claim 3, wherein the shunt circuit is configured to limit the value of the output current flowing during the first period of time to a prescribed upper limit or less.

5. The lighting device of claim 2, wherein the shunt circuit is configured to limit the value of the output current flowing during the first period of time to a prescribed upper limit or less.

6. The lighting device of claim 1, wherein the solid light sources includes at least two adjoining solid light sources between the first polarity and second polarity output terminals, the adjoining solid light sources being connected in series, the adjoining solid light sources comprising first polarity side solid light source and second polarity side solid light source;

a first light source circuit of the light source circuits has a first voltage as an ON voltage, the first light source circuit including every solid light source, a circuit route of which is nearer to the first polarity output terminal than a circuit route of the second polarity side solid light source, of the solid light sources; and a second light source circuit of the light source circuits has a second voltage as an ON voltage, the second light source circuit including every solid light source, on a side of the first polarity output terminal from the second polarity side solid light source, of the solid light sources.

7. The lighting device of claim 6, wherein the driver circuit is configured to allow a current from the first light source circuit to flow through during a period of time while the pulsating voltage is greater than or equal to the first voltage and less than the second voltage.

8. The lighting device of claim 7, wherein:

in a configuration in which the second polarity side solid light source is a solid light source, a circuit route of which is nearest to the second polarity output terminal, the driver circuit is configured to allow a current from the second light source circuit to flow through during a period of time while the pulsating voltage is greater than or equal to the second ON voltage; and in a configuration in which the second polarity side solid light source is a solid light source other than the solid light source, a circuit route of which is nearest to the second polarity output terminal, the driver circuit is configured to allow a current from the second light source circuit to flow through during a period of time in which the pulsating voltage is greater than or equal to the first ON voltage and less than the second ON voltage.

9. The lighting device of claim 6, wherein the driver circuit is configured to electrically connect the shunt circuit between the first polarity and second polarity output terminals while the pulsating voltage is less than the lowest ON voltage, the lowest ON voltage being an ON voltage of a light source circuit including a solid light source, which is nearest to the first polarity output terminal, of the solid light sources.

10. The lighting device of claim 1, wherein the shunt circuit comprises a bleeder resistor.

11. Lighting equipment, comprising:

the lighting device of claim 1; and a body that holds the lighting device.

* * * * *